US005934309A

United States Patent [19]

Batten

[11] Patent Number: 5,934,309

[45] Date of Patent: Aug. 10, 1999

[54] COLLECTION ASSEMBLY INCORPORATING AIR-BREAK DESIGN

[75] Inventor: William C. Batten, Asheboro, N.C.

[73] Assignee: Clearline Systems, Inc., Asheboro, N.C.

[21] Appl. No.: 09/128,334

[22] Filed: Aug. 3, 1998

[51] Int. Cl.[6] ..... E03C 1/12

[52] U.S. Cl. ..... 137/216; 4/640; 4/679

[58] Field of Search ..... 4/640, 679; 137/216

[56] References Cited

U.S. PATENT DOCUMENTS

| | | | |
|---|---|---|---|
| 408,692 | 8/1889 | Clifford et al. . | |
| 692,706 | 2/1902 | Poate | 4/640 |
| 1,183,568 | 5/1916 | Keevan . | |
| 2,250,974 | 7/1941 | Stoddard | 137/21 |
| 2,878,826 | 3/1959 | Dolenga | 137/216 |
| 3,155,106 | 11/1964 | Baron | 137/216 |
| 3,455,324 | 7/1969 | Bieri et al. | 137/216 |
| 4,480,656 | 11/1984 | Johnson | 137/215 |
| 5,016,667 | 5/1991 | Tolf | 137/143 |
| 5,159,958 | 11/1992 | Sand | 137/888 |
| 5,305,778 | 4/1994 | Traylor | 137/216 |
| 5,454,396 | 10/1995 | Hochstrasser | 137/218 |
| 5,482,621 | 1/1996 | Nurse | 210/170 |
| 5,678,592 | 10/1997 | Boticki et al. | 137/216 |

*Primary Examiner*—Gerald A. Michalsky
*Attorney, Agent, or Firm*—Rhodes & Mason, P.L.L.C.

[57] ABSTRACT

A collection apparatus for the collection and disposal of effluent from multiple sinks is provided that effectively maintains air gap and sanitation requirements within a minimal vertical distance. The preferred embodiment of present invention has multiple sinks with downwardly disposed drains and a trough mounted to collect the effluent flow from the drains. The trough has a discharge end, an overflow end, and a generally rounded bottom extending beneath the sinks and upwardly open to effluent discharging from the drains. The trough is mounted to induce effluent flow to the discharge end of the trough. The effluent flows from the sink drain through flow diverters located on the drains toward the discharge end of the trough through an air gap and into the trough. The air gap is provided between the lower end of the flow diverter and the bottom of the trough. The effluent is discharged from the trough through the discharge end into a grease separator. If the effluent flow path becomes obstructed, the effluent is discharged through the overflow end of the trough and is not able to backflow into the sink.

16 Claims, 1 Drawing Sheet

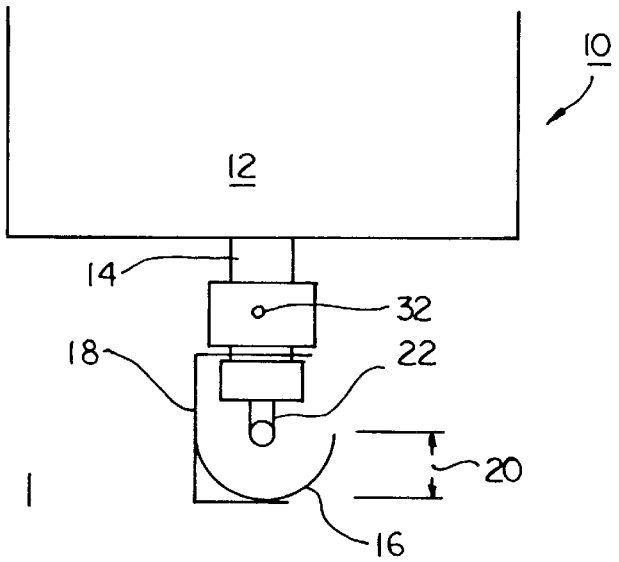
FIG. 1
FIG. 2
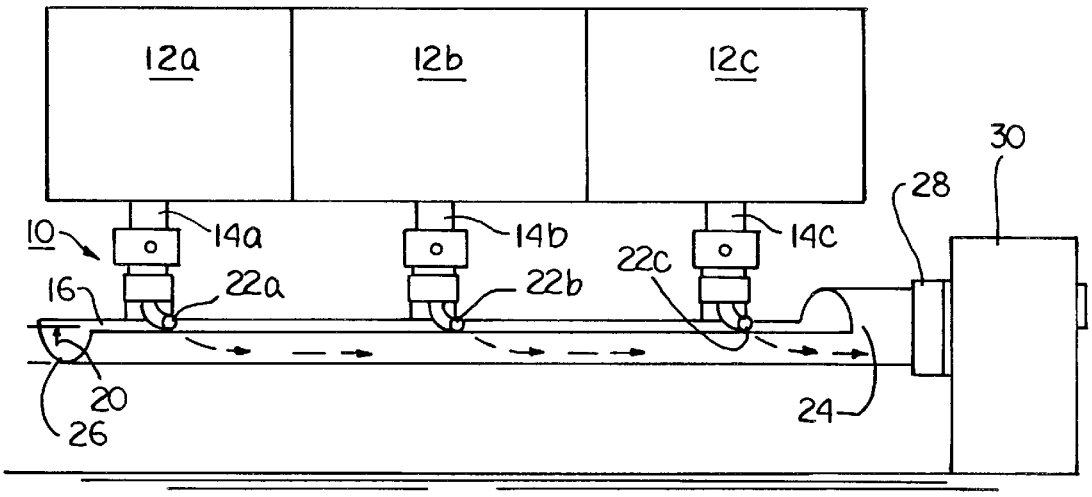

COLLECTION ASSEMBLY INCORPORATING AIR-BREAK DESIGN

BACKGROUND OF THE INVENTION

This invention relates to an assembly for receiving flows from a sink or other apparatus and, more particularly, to the prevention of a backflow, or back siphoning, in a fluid handling system. This apparatus, therefore, provides a connection that satisfies a minimum air-gap separation requirement.

In order to maintain sanitary conditions, plumbing and health code regulations require device drains to be individually drained with a flow passing through a minimum air space to preclude potential cross-contamination caused by fluids migrating upstream due to a downstream blockage. Traditional air-gap connection methods have commonly used a pipe-and-cup arrangement. Effluent flows through a drain, passes through a mandated air-gap into a cup, and then passes through a pipe to a remote location. This conventional set-up requires an adequate vertical distance to be available. However, in many modem commercial kitchens, most devices discharge low to the floor and preclude such a pipe-and-cup design, particularly if other equipment needs to be installed downstream of the drain. A particular item of this sort is the Big Dipper® grease separator sold by Thermaco, Inc. of Asheboro, N.C. Grease separators remove oil and grease from kitchen sink effluent so that the remaining effluent is easier to process, in compliance with many sewage district codes. The oil/grease separators have tanks with quiescent zones to permit the oil and grease to float on top of the water and be susceptible to removal. Such tanks need vertical height, which may not be available in traditional air-gap drains.

A key characteristic of many backflow prevention techniques is that they must be oriented vertically. Examples of such devices are disclosed in U.S. Pat. Nos. 3,455,324 (Bieri et al.), 5,159,958 (Sand), 5,305,778 (Traylor), and 5,678,592 (Boticki et al.), among several others. For backflow prevention, the Bieri device includes a nozzle and a diffuser that are aligned with one another and the discharge end of the nozzle is spaced from the inlet end of the diffuser to provide therebetween an air-gap through which water flows. Likewise, the Sand device prevents backflow by locating an air-gap chamber downstream of a nozzle and upstream of a conical sloped orifice. Sand is also an example of a backflow prevention technique that is combined with Venturi-type mixing devices, sometimes known as eductors.

A problem with the above-identified devices is that when the water stream flows from the drain across the air-gap to the opening, for example, as described in Sand as a conical sloped portion, there is a tendency for lateral splash-out toward the slots leading to ambient air. Attempts to prevent such splash-out include upwardly-extending tabs or radially inwardly offset transparent windows. However, it is understood that persons charged with enforcing plumbing codes find these techniques objectionable because either they are prevented from visually observing the presence of the air-gap or prevented from physically passing an object or a finger through the air-gap.

Yet another characteristic of eductor-type backflow preventers is that reasonably high water pressure is required to provide adequate downstream pressure drop to drive the eductor for satisfactory mixing.

There remains, therefore, a need in the art for a backflow prevention device that need not be oriented vertically but still maintains the mandated air-gap separation. Sometimes, vertical orientation is not practical or even possible. An assembly that is able to keep the air-gap distance and vertical dimension substantially the same would have substantial commercial utility.

SUMMARY OF THE INVENTION

An assembly of the present invention may be retrofitted to existing sinks, or other similar apparatus, without significant difficulty or hardship. Using the inertia of a flowing liquid, such as kitchen effluent, a collection trough is used to route the discharged flow from single or multiple device discharges while still providing the required safe air-gap separation.

The present invention relates to a trough assembly for receiving sink discharge flows. In operation, sink contents flow from the sink, through the sink drain, through the mandated air-gap, and into a trough extending underneath the sink.

The trough has two ends, one remains open while the other, the discharge end of the trough, is preferably connected to a grease separator for separation and disposal of the grease from grease-containing effluent.

If a clog should occur due to blockage in the trough, in the grease separator, or downstream thereof, the fluids cannot back up into any sink but rather accumulate in the trough and overflow out the open end of the trough. Thus, the invention provides the desired sanitary backflow protection.

Flow diverters may be attached to the bottom of the sink drains to direct flow substantially parallel to the bottom of the trough toward the discharge end. Further, the trough may be mounted, through any appropriate means, to induce flow to the discharge end of the trough.

The flow diverters may be made of an assembly including a cap that is threaded onto the lower end of the sink drain and a 90° elbow diverter coupled to the cap. The diverter may be of a smaller diameter than the diameter of both the cap and sink drain so as to act as a nozzle, thereby imparting momentum to the effluent in the direction of the discharged end of the trough. These flow diverters allow for the minimum possible vertical distance while still maintaining an appropriate air-gap distance. Thus, it is possible to plumb a receiving appliance to a multiple compartment sink in a short vertical distance coupling arrangement while maintaining sanitary air-gap separation.

Other features and advantages of the invention will become apparent from the following detailed description, taken in conjunction with the accompanying drawings which illustrate features of the invention.

BRIEF DESCRIPTION OF THE DRAWINGS

FIG. 1 is an end view of the collection assembly of the present invention.

FIG. 2 is a front view of an embodiment of the collection assembly of the present invention for use with multiple sinks.

DETAILED DESCRIPTION OF THE PREFERRED EMBODIMENT

As seen in FIG. 1, the apparatus, shown generally at 10, has at least one sink 12 with a downwardly disposed drain 14. The sink drain 14 empties into a trough 16 mounted through any appropriate means beneath the sink 12 such as a support bracket 18 as in FIG. 1.

As in FIG. 2, multiple sinks 12*a*, 12*b*, 12*c* may drain into a common trough 16. An air gap 20 is provided between the lower end of the drain 14 and the bottom of the trough 16. The effluent from the sink flows out the sink drain 14 and passes through the air gap 20 and then is collected into the trough 16.

The shape of the sink 12 and, likewise, the shape of the trough 16 are not critical, however the preferred embodiment has a rounded bottom to both to effectuate the flow of grease. A variety of materials may be used to make the sink and the trough such as plastic, steel, fiberglass, or any other suitable material.

The trough has two ends 24, 26. One end is open 26 and the other, the discharge end 24, is preferably connected to a grease separator 30 for the separation and disposal of the grease component of the effluent. The trough 16 is mounted to induce flow of the effluent to the discharge end 24 of the trough 16. The trough 16 may have a cover 28 to prevent the effluent from splashing out as it drains from the sink, but, the cover 28 must not inhibit the flow of the effluent from the sink drain 14 nor impede the air gap 20.

The air gap 20 is the distance provided between the lower end of the sink drain 14 and the bottom of the trough 16. The air gap 20 can be made to any distance and particularly to a distance specified by plumbing and health code regulations, which is currently 2 inches. So, the vertical dimension of this apparatus 10 is dictated by the air gap distance 20 chosen. This apparatus 10, therefore, may be used to plumb a receiving appliance to a multiple compartment sink 12*a*, 12*b*, 12*c* in a short vertical distance while maintaining the mandated air gap distance 20. Further, should the mandated air gap distance 20 change, the trough 16 may be mounted to provide for the change with relatively little hardship or difficulty.

If the trough 16 should become blocked for any reason such as clogging or failure of the grease separator 30 to accommodate the full flow, the backed up flow would accumulate and exit out of the open, overflow, end 26 of the trough 16. The backed up fluids could not back up into any sink 12*a*, 12*b*, 12*c*, and thus the desired sanitary conditions are realized.

The preferred embodiment incorporates diverters 22*a*, 22*b*, 22*c* attached to the lower ends of the drains 14*a*, 14*b*, 14*c* to divert the flow of the effluent toward the discharge end 24 of the trough 16. The air gap 20 is then provided between the lower end of the diverter 22 and the bottom of the trough 16. The diverter may be an assembly made of a cap 32 that is threaded on the lower end of the sink drain 14 and a 90° elbow diverter 22 coupled to the cap 32. The diverter 22 is preferably of a smaller diameter than the diameter of both the cap 32 and the sink drain 14 so as to act as a nozzle, imparting momentum to the effluent in the direction of the discharge end 24 of the trough 16. The diverter 22 allows for the minimum possible vertical distance while still maintaining an appropriate air gap distance 20.

In the preferred embodiment, FIG. 2, the effluent flows from the sinks 12*a*, 12*b*, 12*c* through their respective drains 14*a*, 14*b*, 14*c*. Then the flow is diverted by diverters 22*a*, 22*b*, 22*c* to flow through the air gap 20 into the trough 16 toward the discharge end 24 of the trough 16 and discharged into a grease separator 30 for eventual separation and disposal.

What is claimed is:

1. An apparatus for draining at least one sink that has a downwardly disposed drain ending in a lower end comprising:

a trough having a discharge end, an unobstructed overflow end, and a bottom upwardly open to effluent discharging from the downwardly disposed drain and extending beneath the sink, said trough being mounted to induce the effluent to flow to said discharge end of the trough and to provide an air gap between the bottom of the trough and the lower end of the drain, whereby effluent discharging from the sink passes through the air gap to reach the trough and thence toward the discharge end of the trough, and any blockage in the trough or downstream thereof causes any backed up flow to exit through the overflow end of the trough and eliminates any backflow into the sink.

2. An apparatus as claimed in claim 1 further comprising:

a flow diverter mounted to the downwardly disposed drain and forming the lower end thereof to divert downward flowing effluent toward said discharge end of said trough, the air gap extending from the lower end of the diverter to the bottom of the trough.

3. An apparatus as claimed in claim 2 wherein said diverter includes a reduced diameter flow passage downstream of the drain, to increase the linear flow rate of the effluent as it is discharged to the trough.

4. An apparatus as claimed in claim 2 wherein said flow diverter includes a threaded cap that is connected to the lower end of said sink drain and a 90° elbow pipe that is connected to said threaded cap to divert the effluent flow toward said discharge end of said trough.

5. An apparatus as claimed in claim 4 wherein the diameter of said diverter is smaller than the diameter of said lower end of said sink drain.

6. An apparatus as claimed in claim 1 wherein said trough is long enough for effluent from multiple sinks to discharge into said trough for common disposal.

7. An apparatus as claimed in claim 6 further comprising:

flow diverters mounted to the downwardly disposed drains and forming the lower ends thereof to divert downward flowing effluent toward said discharge end of said trough, the air gap extending from the lower ends of the diverters to the bottom floor of the trough.

8. An apparatus as is claimed in claim 1 wherein said trough has a generally rounded bottom.

9. An apparatus as claimed in claim 1 wherein said air gap is of a distance specified by standardized code regulations.

10. An apparatus as claimed in claim 1 further comprising:

a grease separator at the discharge end of said trough.

11. An apparatus for draining multiple sinks that each have a downwardly disposed drain ending in a lower end comprising:

a plurality of flow diverters each mounted to the downwardly disposed drains and forming the lower ends thereof to divert downward flowing effluent, a trough having a discharge end, an unobstructed overflow end, and a generally rounded bottom extending beneath the multiple sinks and upwardly open to effluent discharging from the downwardly disposed drains, said trough being mounted to induce the effluent to flow to the discharge end of the trough located in alignment with the direction of diversion of the effluent and to provide an air gap between the bottom of the trough and the lower end of the flow diverters, a grease separator at said discharge end of said trough, whereby effluent discharging from the sinks passes through the air gap to reach the trough and thence toward the discharge end of the trough, and any blockage in the trough, grease separator, or downstream thereof causes any backed up flow to the exit the overflow end of the trough and not flow backward into one of the sinks.

12. A method of draining at least one sink having a downwardly disposed drain comprising:

accumulating effluent in the sink, draining the effluent from the sink through the downwardly disposed drain, exposing the effluent to an air gap between the drain and a trough having a discharge end and an overflow end and extending beneath the sink, collecting the effluent in the trough, inducing the flow of the effluent toward the discharge end of the trough, and discharging the effluent from either:

a) the discharge end of the trough should the flow path at the discharge end be unobstructed, or b) the overflow end of the trough should the flow path at the discharge end be obstructed and preventing the back flow of effluent into the sink.

13. A method as claimed in claim 12 further comprising the step of:

diverting the effluent flow from the downwardly disposed drain into the trough toward the discharge end of the trough.

14. A method as claimed in claim 13 further comprising the step of:

increasing the linear flow rate of the effluent as it is discharged to the trough by directing the flow through a decreased diameter flow passage downstream of the drain.

15. A method as claimed in claim 12 further comprising the step of:

collecting effluent from multiple sinks in a shared extended trough for common disposal.

16. A method as claimed in claim 12 further comprising the step of:

discharging the effluent from the discharging end of the trough into a grease separator.

* * * * *

UNITED STATES PATENT AND TRADEMARK OFFICE

CERTIFICATE OF CORRECTION

| | | |
|---|---|---|
| PATENT NO | : | 5,934,309 |
| DATED | : | August 10, 1999 |
| INVENTOR(S) | : | Akira Iiboshi et al. |

It is certified that error appears in the above-identified patent and that said Letters Patent are hereby corrected as shown below:

Column 3, line 3, between "vehicle" and "greater," please insert -- is --.

Column 5, line 34, please delete "of."

Column 16, line 15, please delete the first "(".

Column 22, line 14, at the end of the line, please add a "," after "said".

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*